US006558887B2

(12) United States Patent
Helling et al.

(10) Patent No.: US 6,558,887 B2
(45) Date of Patent: May 6, 2003

(54) COLOR PHOTOGRAPHIC SILVER HALIDE MATERIAL

(75) Inventors: Günter Helling, Odenthal (DE); Ralf Weimann, Leverkusen (DE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 10/041,538

(22) Filed: Jan. 8, 2002

(65) Prior Publication Data

US 2002/0136993 A1 Sep. 26, 2002

(30) Foreign Application Priority Data

Jan. 12, 2001 (DE) ..... 101 01 222

(51) Int. Cl.[7] ..... G03C 1/815; G03C 1/825

(52) U.S. Cl. ..... 430/512; 430/507; 430/552; 430/553; 430/546; 430/931

(58) Field of Search ..... 430/507, 512, 430/931, 552, 553, 546

(56) References Cited

U.S. PATENT DOCUMENTS

| | | | | | |
|---|---|---|---|---|---|
| 4,184,876 | A | | 1/1980 | Eeles et al. | 430/505 |
| 5,489,503 | A | * | 2/1996 | Toan | 430/512 |
| 5,538,840 | A | * | 7/1996 | Van Toan et al. | 430/507 |
| 6,180,331 | B1 | * | 1/2001 | Begley et al. | 430/552 |
| 6,190,850 | B1 | * | 2/2001 | Begley et al. | 430/552 |
| 6,190,851 | B1 | * | 2/2001 | Harder et al. | 430/552 |
| 6,194,132 | B1 | * | 2/2001 | Begley et al. | 430/553 |
| 6,197,492 | B1 | * | 3/2001 | Begley et al. | 430/552 |
| 6,207,363 | B1 | * | 3/2001 | Begley et al. | 430/552 |
| 6,261,755 | B1 | * | 7/2001 | Gibson et al. | 430/552 |
| 6,268,116 | B1 | * | 7/2001 | Roberts et al. | 430/512 |
| 6,280,916 | B1 | * | 8/2001 | Roberts | 430/502 |
| 6,312,880 | B1 | * | 11/2001 | Roberts et al. | 430/512 |
| 6,387,606 | B1 | * | 5/2002 | Begley et al. | 430/553 |

FOREIGN PATENT DOCUMENTS

| | | |
|---|---|---|
| DE | 25 30 645 | 1/1976 |
| DE | 195 38 950 | 4/1997 |
| EP | 1 035 432 | 9/2000 |

* cited by examiner

*Primary Examiner*—Geraldine Letscher
(74) *Attorney, Agent, or Firm*—Connolly Bove Lodge & Hutz LLP

(57) ABSTRACT

A color photographic silver halide material containing in at least one red-sensitive layer a cyan coupler having formula (I)

(I)

and in a photosensitive or non-photosensitive layer a UV absorber having formula (II)

(II)

where $R^1$ to $R^4$, $R^{11}$ to $R^{16}$, Z, m, n and o have the meanings specified in the description, is characterised by good light and dark stability and low secondary densities.

13 Claims, No Drawings

COLOR PHOTOGRAPHIC SILVER HALIDE MATERIAL

The invention concerns a color photographic silver halide material having improved color reproduction in cyan.

The use of phenols having a carbonyl amino group in the 2 position, a hydrogen atom or a leaving group in the 4 position and a sulfonyl methyl carbonyl amino group, optionally further substituted at the methyl C atom, in the 5 position as cyan couplers is known (EP 1 035432; DE 199 60 899).

Color photographic materials, particularly print materials, containing these couplers display outstanding properties after exposure and processing, but absorption of the cyan dye is still not in the optimum range, where the human eye has the greatest sensitivity.

Moreover, the light resistance of print materials containing these couplers is inadequate.

The object of the invention was to remedy this disadvantage.

It has now been found that this object is achieved by the use of novel UV absorbers.

The invention therefore provides a color photographic silver halide material with a support, at least one red-sensitive, cyan-coupling silver halide emulsion layer and at least one non-photosensitive layer, characterised in that in the at least one red-sensitive layer it contains a cyan coupler having formula (I)

(I)

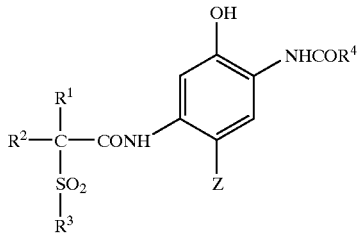

where $R^1$ and $R^2$ mutually independently denote a hydrogen atom or an unsubstituted or substituted alkyl group, $R^3$ and $R^4$ mutually independently denote an unsubstituted or substituted alkyl, aryl, amino, alkoxy or heterocyclic group and Z denotes a hydrogen atom or a group that can be eliminated under the conditions of chromogenic development, and in a photosensitive or non-photosensitive layer it contains a UV absorber having formula (II)

(II)

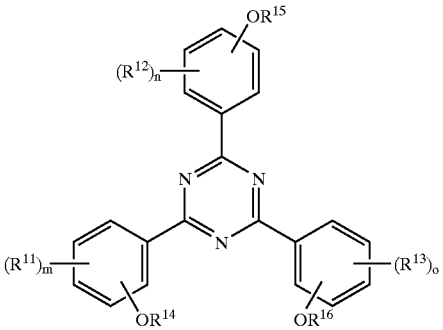

where $R^{11}$, $R^{12}$ and $R^{13}$ mutually independently denote halogen, hydroxy, mercapto, alkyl, aryl, alkoxy, aryloxy, acyloxy, alkylthio, arylthio, —$NR^{17}$—$R^{18}$, alkoxycarbonyl, carbamoyl or sulfamoyl;

$R^{14}$, $R^{15}$ and $R^{16}$ mutually independently denote a hydrogen atom or an alkyl group;

$R^{17}$ denotes H, alkyl or aryl;

$R^{18}$ denotes H, alkyl, aryl, acyl, alkoxycarbonyl, carbamoyl, sulfamoyl or sulfonyl; and m, n and o are the same or different and denote 1, 2, 3 or 4.

Suitable cyan couplers having formula (I) are:

I-1:

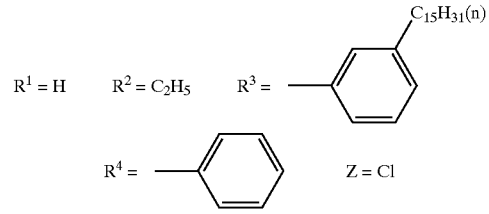

I-2:

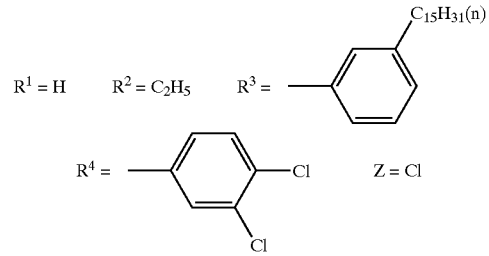

I-3:

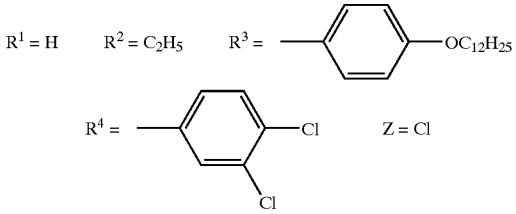

I-4:

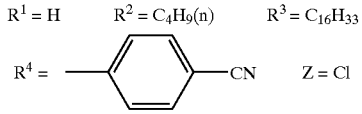

I-5:

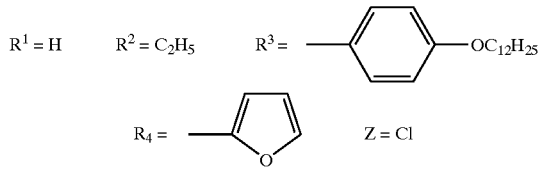

I-6:

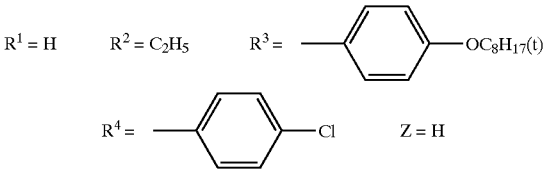

-continued

I-7:

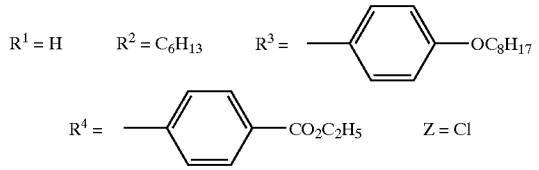

I-8:

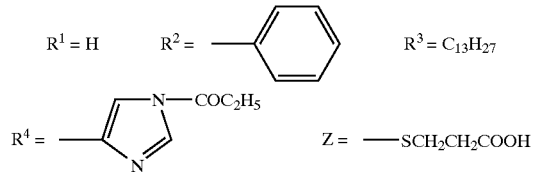

I-9:

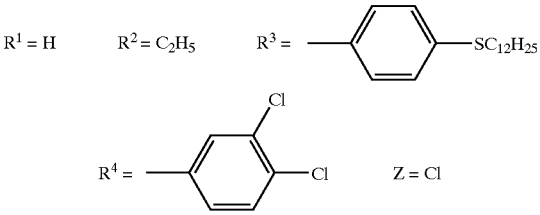

Other suitable couplers can be found in the publications cited at the beginning.

The UV absorbers having formula (II) contain the groups $OR^{14}$, $OR^{15}$ and $OR^{16}$ preferably in the ortho position of the relevant phenyl ring for coupling to the triazine.

$R^{11}$, $R^{12}$ and $R^{13}$ are preferably unsubstituted or substituted alkoxy groups. $R^{11}$, $R^{12}$ and $R^{13}$ preferably share the same meaning.

m, n and o are preferably 1.

The following are examples of preferred compounds according to the invention having formula (II)

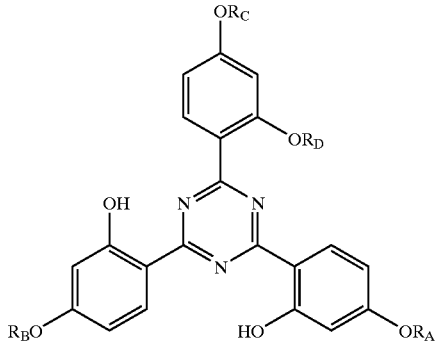

II-1 $R_A = R_B = R_C = C(CH_3)_2CO_2C_2H_5$, $R_D = H$;

II-2 $R_A = R_B = R_C = C_4H_9$, $R_D = C_4H_9$;

II-3 $R_A = R_B = R_C = CH(CH_3)CO_2C_2H_5$ $R_D = H$

Other UV absorbers having formula (II) are known from DE 195 38 950.

Low-molecular or polymeric phenolic oil formers are preferably used as oil formers for the hydroxyphenyl triazine UV absorbers having formula II, in other words phenolic oil formers and the UV absorber having formula II are conveniently dispersed in the form of a common emulsifier in the casting solution for the layer concerned. The quantities required for all layers together are 50 to 1,500 mg/m$^2$, preferably 200 to 700 mg/m$^2$ for the UV absorber and 50 to 1,500 mg/m$^2$, preferably 100 to 500 mg/m$^2$ for the phenolic oil former.

The hydroxyphenyl triazine UV absorber having formula II and the cyan coupler having formula I are preferably dispersed in the form of a common emulsifier in the casting solution for the layer concerned. The quantities required are 50–1,500 mg/m$^2$, preferably 200 to 700 mg/m$^2$ for the UV absorber and 50–1,500 mg/m$^2$, preferably 100–500 mg/m$^2$ for the cyan coupler.

Examples of color photographic materials are color negative films, color reversal films, color positive films, color photographic paper, color reversal photographic paper, color-sensitive materials for the color diffusion transfer process or the silver color bleach-out process.

The photographic materials consist of a support to which at least one photosensitive silver halide emulsion layer is applied. Thin films and foils are particularly suitable as supports. An overview of support materials and the auxiliary layers applied to their front and back is provided in Research Disclosure 37254, Part 1 (1995), p. 285.

The color photographic materials conventionally contain at least one red-sensitive, at least one green-sensitive and at least one blue-sensitive silver halide emulsion layer, optionally together with interlayers and protective layers.

The arrangement of these layers can differ according to the type of photographic material. Arrangements for the most important products are described below:

Color photographic films such as color negative films and color reversal films display the following sequence of layers on the support: 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. Layers having the same spectral sensitivity differ in their photographic sensitivity, whereby the less sensitive part-layers are generally positioned closer to the support than the more highly sensitive part-layers.

Between the green-sensitive and the blue-sensitive layers there is conventionally a yellow filter layer, which prevents blue light from reaching the layers below it.

The various possibilities for arranging the layers and their effects on the photographic properties are described in J. Int. Rec. Mats., 1994, Vol. 22, pages 183 to 193.

Color photographic paper, which is generally less photosensitive than a color photographic film, conventionally displays the following sequence of layers on the support: one blue-sensitive, yellow-coupling silver halide emulsion layer, one green-sensitive, magenta-coupling silver halide emulsion layer and one red-sensitive, cyan coupling silver halide emulsion layer; the yellow filter layer is not required.

The number and arrangement of the photosensitive layers can be varied in order to obtain specific results. For example, all highly sensitive layers in a photographic film can be combined to form one stack of layers and all low-sensitivity layers combined to form another stack of layers in order to increase the sensitivity (DE 25 30 645).

Essential components of the photographic emulsion layers are binders, silver halide grains and color couplers.

Details of suitable binders can be found in Research Disclosure 37254, Part 2 (1995), p. 286.

Details of suitable silver halide emulsions, their production, digestion, stabilisation and spectral sensitisation including suitable spectral sensitisers can be found in Research Disclosure 37254, Part 3 (1995), p. 286 and in Research Disclosure 37038, Part XV (1995), p. 89.

Photographic materials with camera sensitivity conventionally contain silver bromide iodide emulsions, which can optionally also contain small amounts of silver chloride.

Photographic copier materials contain either silver chloride bromide emulsions with up to 80 mol % AgBr or silver chloride bromide emulsions with over 95 mol % AgCl.

Details of color couplers can be found in Research Disclosure 37254, Part 4 (1995), p. 288 and in Research Disclosure 37038, Part II (1995), p. 80. The maximum absorption of the dyes formed from the couplers and the color developer oxidation product is preferably in the following ranges: yellow coupler 430 to 460 nm, magenta coupler 540 to 560 nm, cyan coupler 630 to 700 nm.

Compounds that during reaction with the developer oxidation product release compounds that are photographically active, e.g. DIR couplers, which release a development inhibitor, are commonly used in color photographic films to improve sensitivity, graininess, sharpness and color separation.

Details of such compounds, especially couplers, can be found in Research Disclosure 37254, Part 5 (1995), p. 290 and in Research Disclosure 37038, Part XIV (1995), p. 86.

The mostly hydrophobic color couplers, as well as other hydrophobic components of the layers, are conventionally dissolved or dispersed in high-boiling organic solvents known as oil formers. These solutions or dispersions are then emulsified in an aqueous binder solution (conventionally a gelatin solution) and are present in the layers as fine droplets (0.05 to 0.8 $\mu$m in diameter) after the layers have dried.

Suitable high-boiling organic solvents, methods of incorporating them into the layers of a photographic material and other methods of incorporating chemical compounds into photographic layers can be found in Research Disclosure 37254, Part 6 (1995), p. 292. Phenolic oil formers are particularly suitable.

The non-photosensitive interlayers generally positioned between layers of differing spectral sensitivity can contain agents that prevent an undesirable diffusion of developer oxidation products from one photosensitive layer to another photosensitive layer with a different spectral sensitisation.

Suitable compounds (white couplers, scavengers or EOP scavengers) can be found in Research Disclosure 37254, Part 7 (1995), p. 292 and in Research Disclosure 37038, Part III (1995), p. 84.

The photographic material can also additionally contain other UV light-absorbing compounds together with optical brighteners, spacers, filter dyes, formalin scavengers, light stabilisers, antioxidants, $D_{min}$ dyes, additives for improving the stability of dyes, couplers and whites and to reduce color fog, plasticisers (latices), biocides, and others.

Suitable compounds can be found in Research Disclosure 37254, Part 8 (1995), p. 292 and in Research Disclosure 37038, Parts IV, V, VI, VU, X, XI and XIII (1995), p. 84 ff.

The layers of color photographic materials are conventionally cured, in other words the binder used, preferably gelatin, is crosslinked by means of suitable chemical processes.

Suitable curing agents can be found in Research Disclosure 37254, Part 9 (1995), p. 294 and in Research Disclosure 37038, Part XII (1995), page 86.

After being exposed as images, color photographic materials are processed by various methods according to their nature. Details of procedures and the chemicals required are disclosed in Research Disclosure 37254, Part 10 (1995), p. 294 and in Research Disclosure 37038, Parts XVI to XXIII (1995), p. 95 ff. together with materials serving as examples.

EXAMPLES

Example 1

A multilayer color photographic recording material was produced by applying the following layers in the specified sequence to a support consisting of paper coated on both sides with polyethylene. All quantities relate to 1 $m^2$ and the amount of silver is stated as $AgNO_3$:

| | |
|---|---|
| | 1st layer (substrate layer) |
| 0.10 g | gelatin |
| | 2nd layer (blue-sensitive layer) |
| | blue-sensitive silver halide emulsion (99.5 mol % chloride and 0.5 mol % bromide, average grain size 0.9 $\mu$m) consisting of |
| 0.50 g | $AgNO_3$ and |
| 1.25 g | gelatin |
| 0.42 g | yellow coupler Y-1 |
| 0.18 g | yellow coupler Y-2 |
| 0.50 g | tricresyl phosphate (TCP) |
| 0.10 g | stabiliser ST-3 |
| 0.70 mg | blue sensitiser Se-1 |
| 0.30 mg | sensitiser ST-4 |
| | 3rd layer (interlayer) |
| 1.10 g | gelatin |
| 0.06 g | oxform scavenger O-1 |
| 0.03 g | oxform scavenger O-2 |
| 0.03 g | oxform scavenger O-3 |
| 0.12 g | TCP |
| | 4th layer (green-sensitive layer) |
| | green-sensitised silver halide emulsion (99.5 mol % chloride, 0.5 mol % bromide, average grain size 0.47 $\mu$m) consisting of |
| 0.25 g | $AgNO_3$ and |
| 1.20 g | gelatin |
| 0.25 g | magenta coupler M-1 |
| 0.25 g | stabiliser ST-1 |
| 0.20 g | stabiliser ST-2 |
| 0.50 g | dibutyl adipate |
| 0.70 mg | green sensitiser Se-2 |
| 0.50 mg | stabiliser ST-5 |
| | 5th layer (UV protective layer) |
| 1.15 g | gelatin |
| 0.50 g | UV absorber UV-1 |
| 0.10 g | UV absorber UV-2 |
| 0.03 g | oxform scavenger O-1 |
| 0.03 g | oxform scavenger O-2 |
| 0.35 g | TCP |
| | 6th layer (red-sensitive layer) |
| | red-sensitised silver halide emulsion (99.5 mol % chloride, 0.5 mol % bromide, average grain size 0.5 $\mu$m) consisting of |
| 0.30 g | $AgNO_3$ and |
| 1.00 g | gelatin |
| 0.46 g | cyan coupler BG-1 |
| 0.46 g | TCP |
| 0.03 mg | red sensitiser Se-3 |
| 0.60 mg | stabiliser ST-6 |
| | 7th layer (UV protective layer) |
| 0.35 g | gelatin |
| 0.15 g | UV absorber UV-1 |
| 0.03 g | UV absorber UV-2 |
| 0.09 g | TCP |
| | 8th layer (protective layer) |
| 0.90 g | gelatin |
| 0.05 g | optical brightener W-1 |
| 0.07 g | polyvinyl pyrrolidone |
| 1.20 mg | silicone oil |
| 2.50 mg | spacer (polymethyl methacrylate) |
| 0.30 g | curing agent H-1 |

The color photographic recording material is exposed by means of a step wedge. Additional filters are inserted into the beam path of the exposure unit so that the wedge appears neutral at an optical density of D=0.6. The exposed material is processed as shown in the chart below:

| Step | Time | Temperature |
|---|---|---|
| Developing | 45 sec | 35° C. |
| Bleach-fixing | 45 sec | 35° C. |
| Washing | 90 sec | 33° C. |

The processing baths were prepared according to the following specification:

| Colour developer solution | |
|---|---|
| Tetraethylene glycol | 20.0 g |
| N,N-diethyl hydroxylamine | 4.0 g |
| N-ethyl-N-(2-methane sulfonamido)ethyl-4-amino-3-methylbenzene sulfate | 5.0 g |
| Potassium sulfite | 0.2 g |
| Potassium carbonate | 30.0 g |
| Polymaleic anhydride | 2.5 g |
| Hydroxyethane diphosphonic acid | 0.2 g |
| Optical brightener (4,4'-diaminostilbene sulfonic acid derivative) | 2.0 g |
| Potassium bromide | 0.02 g |

Top up with water to 1000 ml, adjust pH value with KOH or $H_2SO_4$ to pH 10.2.

| Bleach-fixing bath solution | |
|---|---|
| Ammonium thiosulfate | 75.0 g |
| Sodium hydrogen sulfite | 13.5 g |
| Ethylene diamine tetraacetic acid (iron-ammonium salt) | 45.0 g |

Top up with water to 1000 ml, adjust pH value with ammonia (25 wt. %) or acetic acid to pH 6.0.

The percentage secondary color densities for yellow and magenta at a cyan density $D_{bg}$=1.0 are then determined ($SD_y$, $SD_m$). The results are set out in Table 1. The samples are also stored in the dark for 42 days at 85° C. and 60% relative humidity and the percentage reductions in density determined at the maximum density ($\Delta D_{max}$). Other samples are exposed with light from a xenon lamp standardised to daylight at 35° C. and 85% relative humidity with $15 \cdot 10^6$ lux·h. The reduction in density at D=1.0 is then determined [$\Delta D_{1.0}$].

It can be seen from Table 1 that good light and dark stability and low secondary color densities are only achieved simultaneously when cyan couplers having formula I and UV absorbers having formula II are used.

TABLE 1

(V: reference; E: according to the invention)

| Layer construction | Layer 6 Cyan coupler | Layer 6 UV absorber | Layer 6 Oil former | Secondary colour density (%) $SD_y$ | Secondary colour density (%) $SD_m$ | Dark stability $\Delta D_{max}$ (%) | Light stability $\Delta D_{1.0}$ (%) |
|---|---|---|---|---|---|---|---|
| 101 (V) | BG-1 | — | TCP | 11.7 | 28.2 | −37 | −28 |
| 102 (V) | BG-1 | II-2 | TCP | 11.9 | 29.1 | −35 | −29 |
| 103 (V) | I-5 | UV-1 | TCP | 9.4 | 25.7 | −8 | −27 |
| 104 (E) | I-5 | II-2 | TCP | 9.2 | 24.9 | −7 | −15 |
| 105 (E) | I-5 | II-2 | OF-1 | 9.0 | 23.6 | −9 | −13 |
| 106 (E) | I-5 | II-2 | OF-2 | 9.5 | 24.0 | −7 | −15 |
| 107 (E) | I-9 | II-2 | TCP | 9.3 | 24.8 | −10 | −12 |
| 108 (E) | I-9 | II-2 | OF-1 | 9.5 | 23.6 | −8 | −13 |

In layer construction 101, 0.46 g of cyan coupler BG-1 and 0.46 g of oil former TCP are used.
In layer constructions 102 to 108, 0.46 g of cyan coupler, 0.23 g of UV absorber and 0.23 g of oil former are used.
In the 5th layer the content of UV absorber UV-1 is reduced by 0.23 g.

Substances used in the examples:

M-1

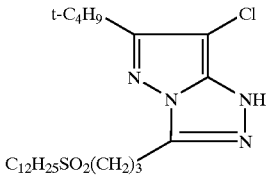

ST-1

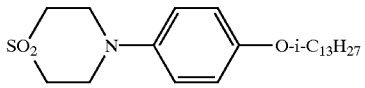

ST-2

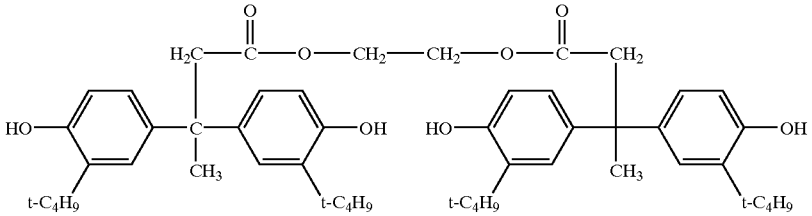

-continued
UV-1
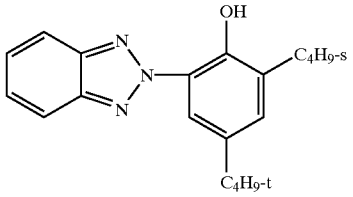
Y-1
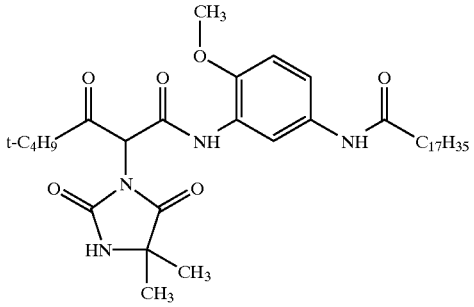
Y-2
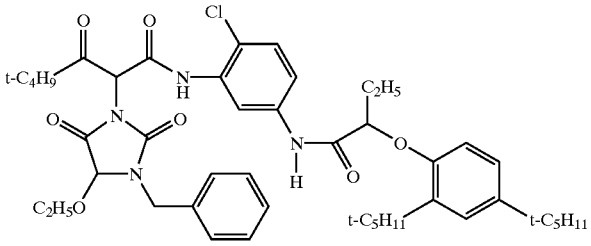
ST-3
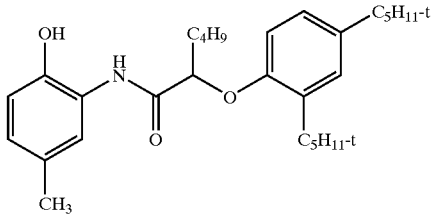
Se-1
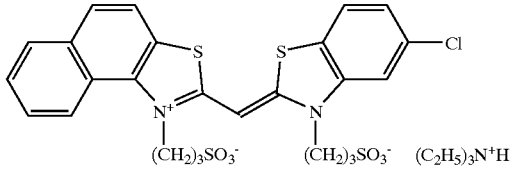
St-4
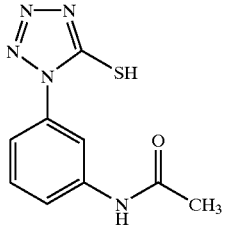
O-1
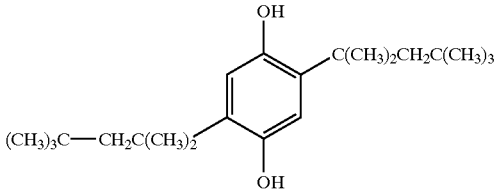
O-2
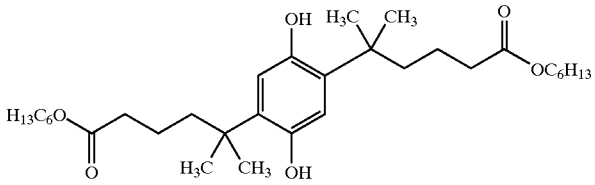
O-3
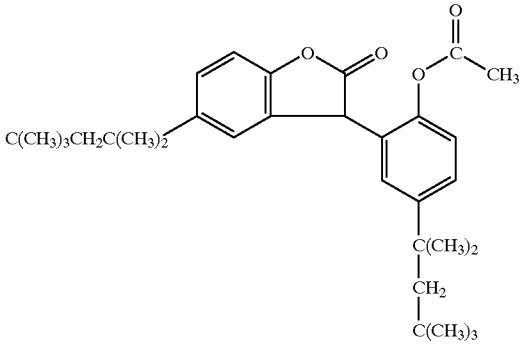
Se-2
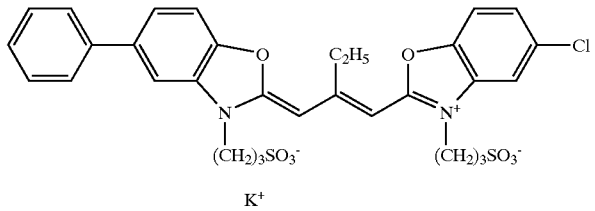

-continued
ST-5
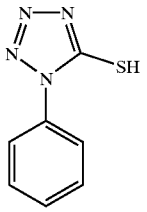
UV-2
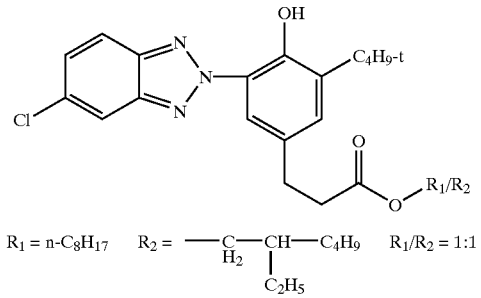
BG-1
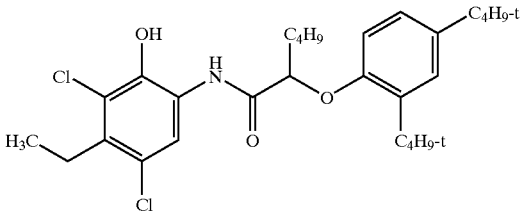
Se-3
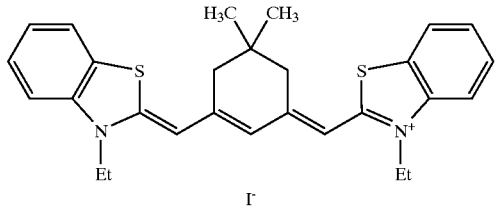
ST-6
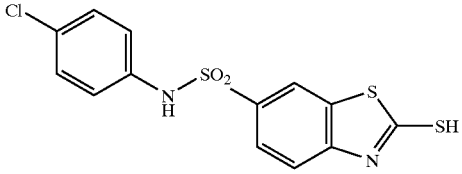
W-1
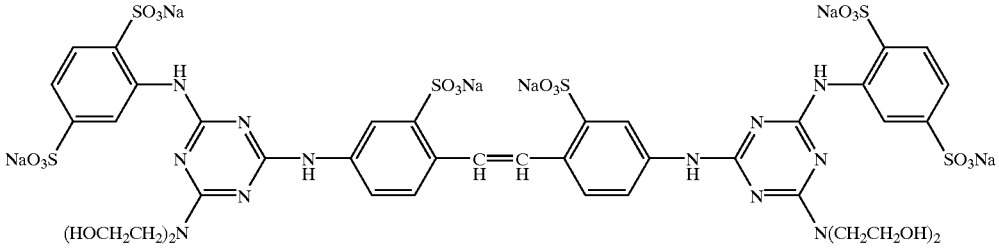
H-1
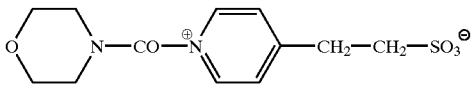
OF-1
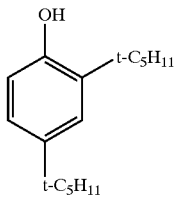
OF-2
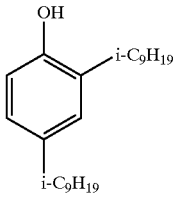
What is claimed is:
1. A color photographic silver halide material comprising a support, at least one red-sensitive, cyan-coupling silver halide emulsion layer and at least one non-photosensitive layer, and said at least one red-sensitive layer contains a cyan coupler having formula (I)

(I)

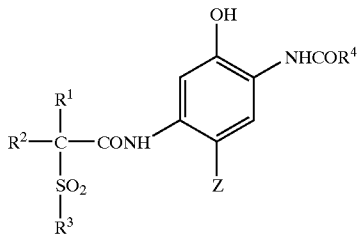

wherein $R^1$ and $R^2$ mutually independently are a hydrogen atom or an unsubstituted or substituted alkyl group, $R^3$ and $R^4$ mutually independently are an unsubstituted or substituted alkyl, aryl, amino, alkoxy or heterocyclic group and Z is a hydrogen atom or a group that is eliminated under the conditions of chromogenic development, and a UV absorber having formula (II) is in a photosensitive sensitive layer or in at least one non-photosensitive layer (II)

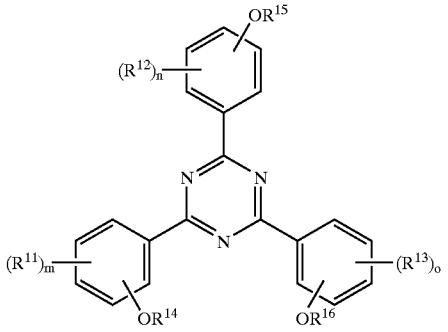

wherein $R^{11}$, $R^{12}$ and $R^{13}$ mutually independently are halogen, hydroxy, mercapto, alkyl, aryl, unsubstituted or substituted alkoxy, aryloxy, acyloxy, alkylthio, arylthio, —$NR^{17}$—$R^{18}$, alkoxycarbonyl, carbamoyl or sulfamoyl;

$R^{14}$, $R^{15}$ and $R^{16}$ mutually independently are a hydrogen atom or an alkyl group;

$R^{17}$ is H, alkyl or aryl;

$R^{18}$ is H, alkyl, aryl, acyl, alkoxycarbonyl, carbamoyl, sulfamoyl or sulfonyl; and m, n and o are the same or different and are 1,2,3 or 4.

2. The color photographic silver halide material according to claim 1, wherein $R^{11}$, $R^{12}$ and $R^{13}$ are unsubstituted or substituted alkoxy groups, m, n and o are 1 and $OR^{14}$ and $OR^{15}$ are in the o-position for coupling with the triazine ring.

3. The color photographic silver halide material according to claim 1, wherein the UV absorbers having formula II are dissolved in a phenolic oil former.

4. The color photographic silver halide material according to claim 3, wherein 50 to 1500 mg of UV absorbers or 50 to 1500 mg of phenolic oil formers are used per $m^2$ for all layers of the material together.

5. The color photographic silver halide material according to claim 1, wherein the cyan coupler having formula I is dissolved in the phenolic oil former together with the UV absorber having formula II and the amount of coupler required is 50 to 1500 mg/$m^2$.

6. The color photographic silver halide material according to claim 1, wherein $R^1$ is hydrogen.

7. The color photographic silver halide material according to claim 1, wherein $R^2$ is ethyl.

8. The color photographic silver halide material according to claim 6, wherein $R^2$ is ethyl.

9. The color photographic silver halide material according to claim 1, wherein $R^3$ is a substituted phenyl and the substituent is an alkyl or an alkoxy.

10. The color photographic silver halide material according to claim 8, wherein $R^3$ is a substituted phenyl and the substituent is an alkyl or an alkoxy.

11. The color photographic silver halide material according to claim 1, wherein Z is Cl.

12. The color photographic silver halide material according to claim 10, wherein Z is Cl.

13. The color photographic silver halide material according to claim 3, wherein 200 to 700 mg of UV absorbers or 100 to 500 mg of phenolic oil formers are used per $m^2$ for all layers of the material together.

* * * * *